US006307328B1

(12) United States Patent
Ko et al.

(10) Patent No.: US 6,307,328 B1
(45) Date of Patent: Oct. 23, 2001

(54) MULTIPURPOSE FLASHLIGHT

(76) Inventors: Wen-Chung Ko, No. 3, Yu Min Street, Hsinchuang City, Taipei Hsien; Chia-Shen Huang, 2nd Fl, 14, Hsin Chung 1st Street, Chung-Li City, TaoYuan Hsien, both of (TW)

( * ) Notice: Subject to any disclaimer, the term of this patent is extended or adjusted under 35 U.S.C. 154(b) by 0 days.

(21) Appl. No.: 09/697,115

(22) Filed: Oct. 27, 2000

(51) Int. Cl.[7] ..... H05B 37/02

(52) U.S. Cl. ..... 315/200 R; 315/76; 315/200 A; 315/DIG. 4

(58) Field of Search ..... 315/200 A, 200 R, 315/DIG. 4, 76, 363

(56) References Cited

U.S. PATENT DOCUMENTS 6,169,373 * 1/2001 Riesinger ..... 315/200 A

* cited by examiner

*Primary Examiner*—David Vu
(74) *Attorney, Agent, or Firm*—Rosenberg, Klein & Lee

(57) ABSTRACT

A multipurpose flashlight is constructed to include a barrel holding a battery, a lamp head connected to one end of the barrel and holding a lamp bulb, a controller formed of a microprocessor, a PNP transistor and a MOS field effect transistor and adapted to regulate the intensity of light of the lamp bulb installed therein, a selector switch adapted to drive the controller to regulate the intensity of light of the lamp bulb, and a trigger switch adapted to drive the microprocessor to flash the lamp bulb.

2 Claims, 5 Drawing Sheets

MULTIPURPOSE FLASHLIGHT

BACKGROUND OF THE INVENTION

The present invention relates to a flashlight and, more particularly, to a multipurpose flashlight, which can be controlled to regulate the intensity of light, or to flash. The multipurpose flashlight comprises a controller formed of a microprocessor, a PNP transistor and a MOS field effect transistor, a selector switch adapted to drive the controller to regulate the intensity of light of the lamp bulb installed in the flashlight, and a trigger switch adapted to drive the microprocessor to flash the lamp bulb.

The flashlight to which the present invention pertains is a small battery-operated portable electric light. Regular flashlights are designed for personal use in the dark for giving light. Because the intensity of light of conventional flashlights are not adjustable, different sizes of flashlights may be used to fit different light intensity requirements (see FIG. 1(A)-(B)-(C)). It is not economic to prepare a set of flashlights of different sizes for use in different conditions. Further, conventional flashlights are not practical for use in a fishing boat or a particular condition to give a flashing signal.

SUMMARY OF THE INVENTION

The present invention has been accomplished under the circumstances in view. It is one object of the present invention to provide a flashlight, which can be controlled to regulate the intensity of light. It is another object of the present invention to provide a flashlight, which can be controlled to give a flashing signal. It is still another object of the present invention to provide a flashlight, which prevents waste of power energy. To achieve these objects, the multipurpose flashlight of the present invention comprises a barrel holding a battery, a lamp head connected to one end of the barrel and holding a lamp bulb, a controller formed of a microprocessor, a PNP transistor and a MOS field effect transistor and adapted to regulate the intensity of light of the lamp bulb installed therein, a selector switch adapted to drive the controller to regulate the intensity of light of the lamp bulb, and a trigger switch adapted to drive the microprocessor to flash the lamp bulb.

DETAILED DESCRIPTION OF THE PREFERRED EMBODIMENT

Figure 1A:
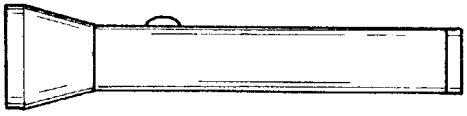
FIG.1(A) PRIOR ART
FIG. 1(A)-(B)-(C) illustrates different flashlights of different sizes constructed according to the prior art.
Figure 1B:
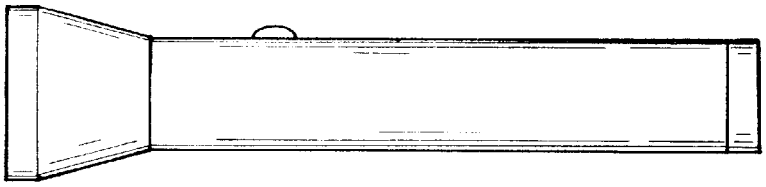
FIG.1(B) PRIOR ART
Figure 1C:
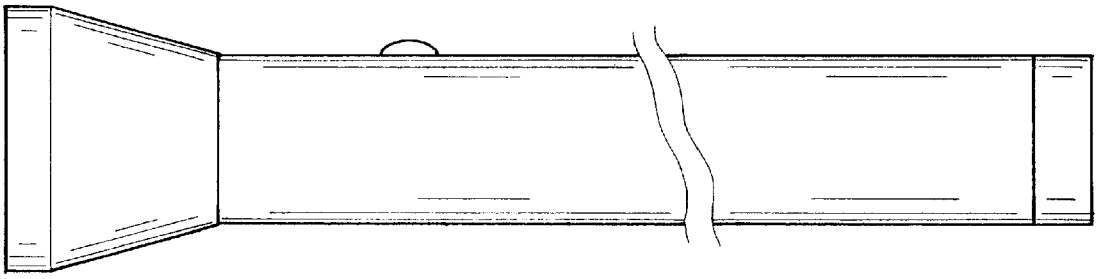
FIG.1(C) PRIOR ART
Figure 2:
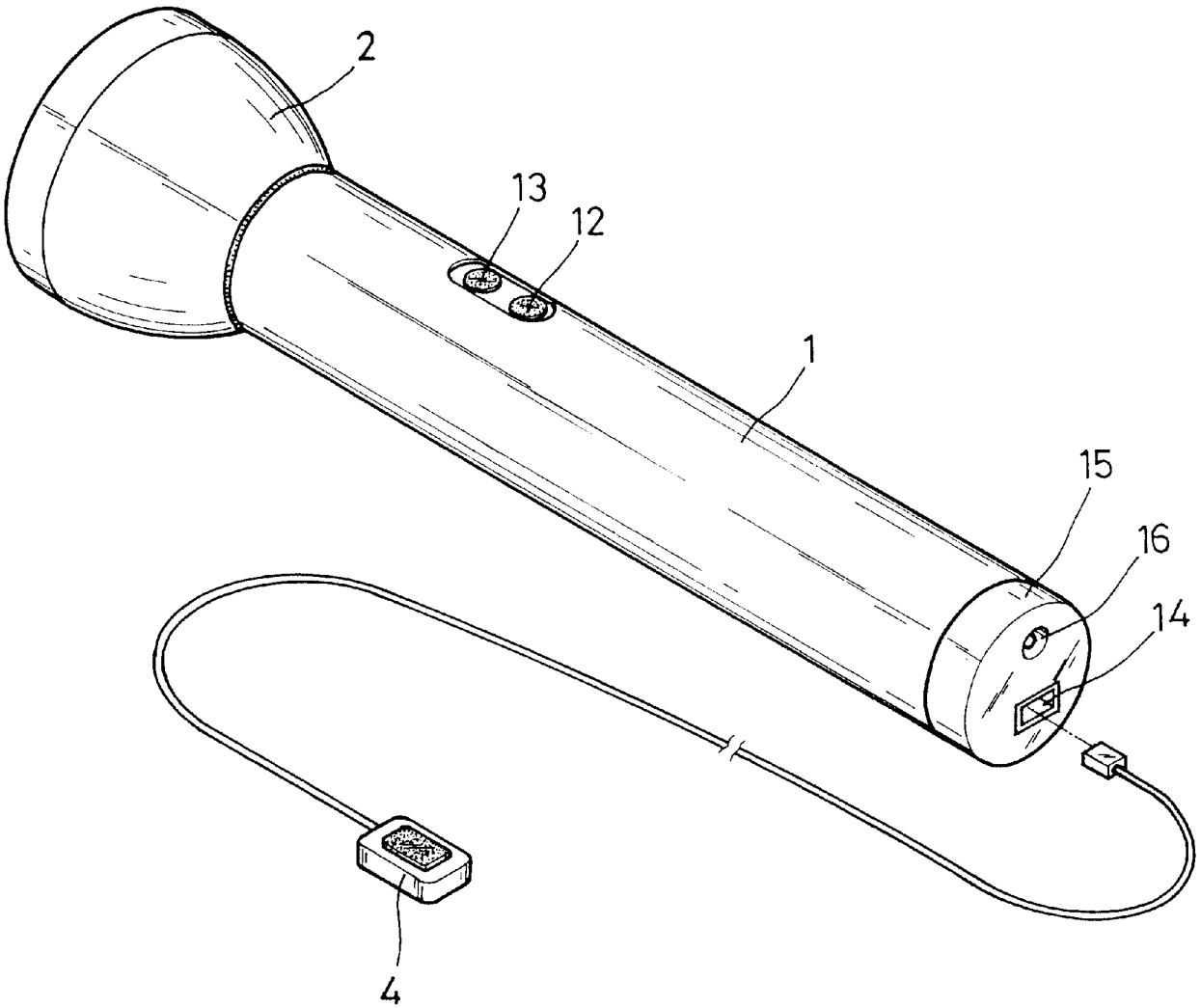
FIG. 2 is an elevational view of a multipurpose flashlight according to the present invention.
Figure 3:
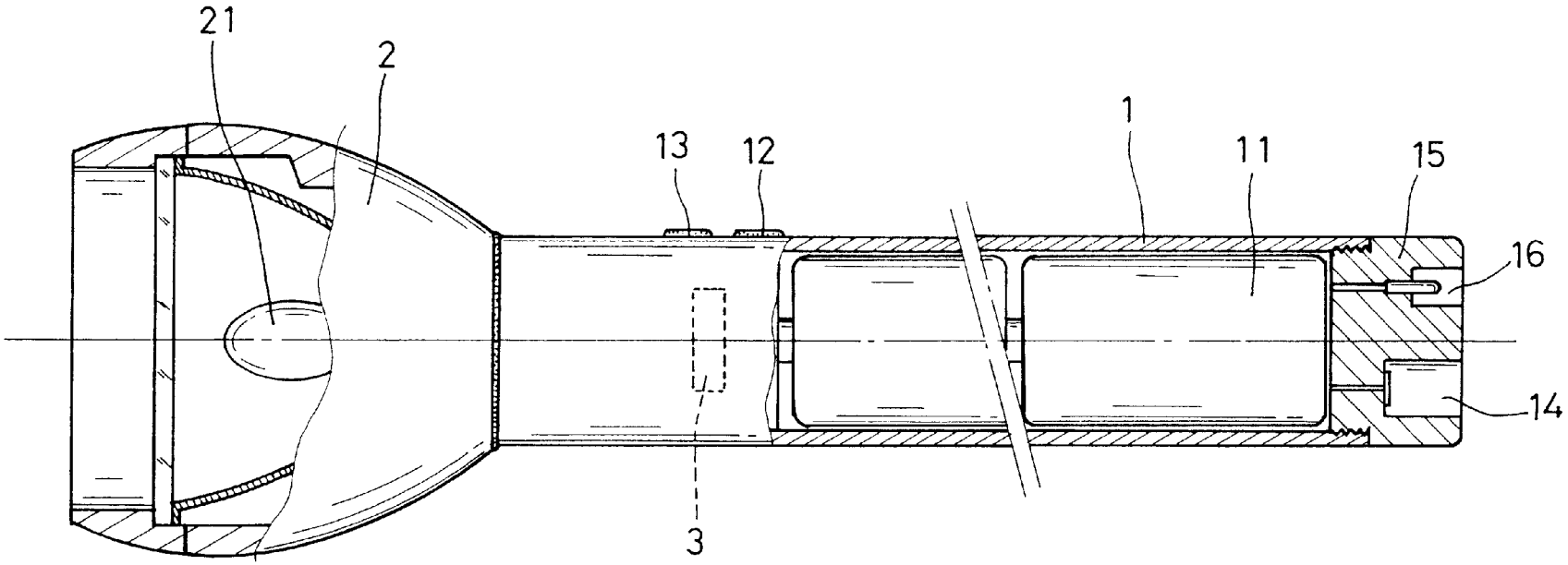
FIG. 3 is a sectional view of the multipurpose flashlight according to the present invention.
Figure 4:
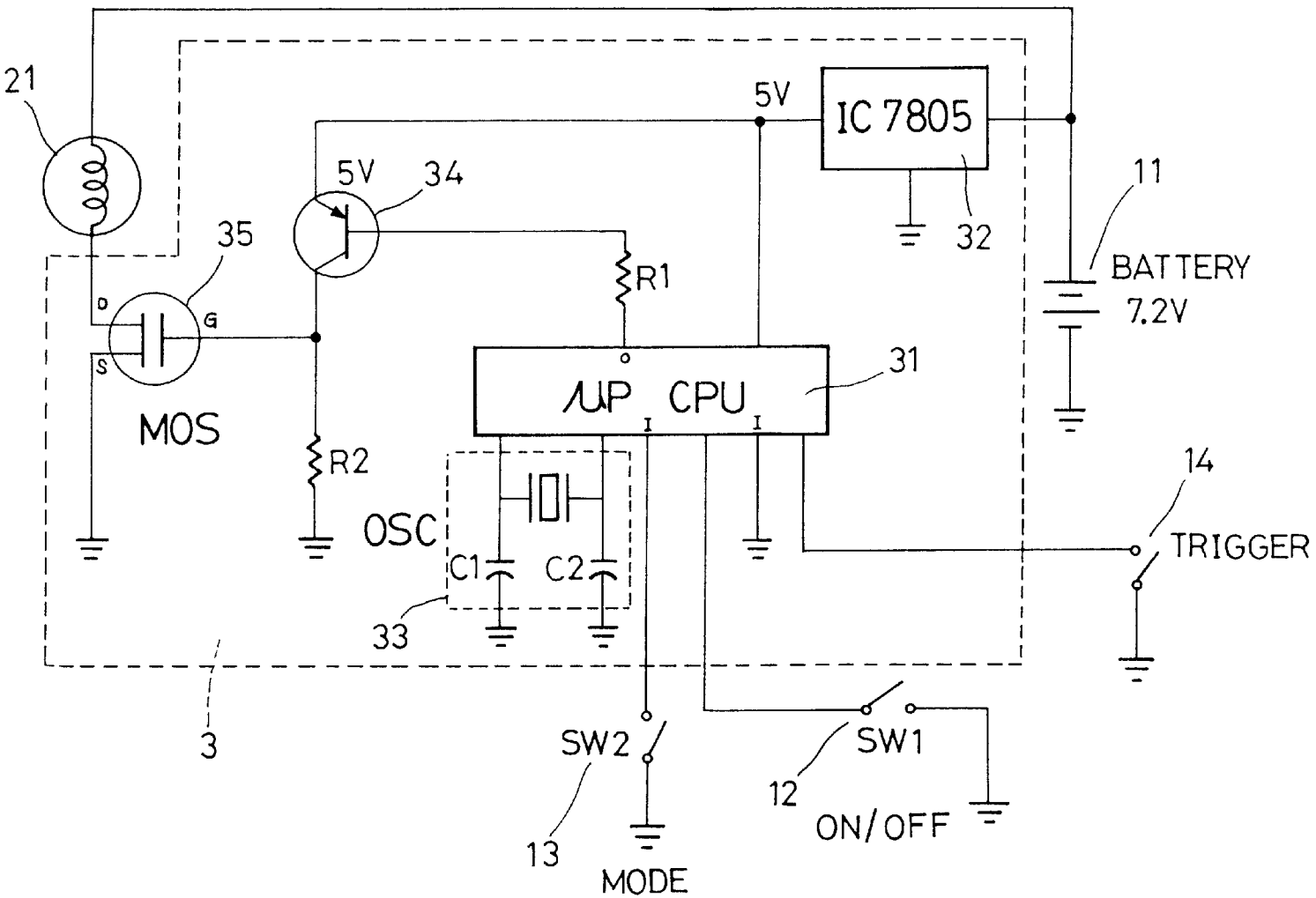
FIG. 4 is a circuit diagram of the controller for the multipurpose flashlight according to the present invention.

Referring to FIGS. from 2 through 4, a multipurpose flashlight in accordance with the present invention comprises a barrel 1 holding a battery 11, an ON/OFF switch 12 and a selector switch 13 mounted on the barrel 1, and a lamp head 2 connected to the front end of the barrel 1 and holding a lamp bulb 21. The battery 11 can be rechargeable. The lamp bulb 21 is electrically connected to the battery 11 through the ON/OFF switch 12.

Referring to FIGS. from 2 through 4 again, the flashlight further comprises a controller 13 installed in the barrel 1, and adapted to regulate the intensity of light of the lamp bulb 21. The controller 13 is comprised of a microprocessor 31, a voltage control IC 32, an oscillator 33, a PNP transistor 34, a MOS field effect transistor 35, and a trigger switch 14. The microprocessor 31 obtains the necessary working voltage from the battery 11 through the voltage control IC 32. The voltage control IC 32 is an IC7805 that changes 7.2V battery voltage to 5V voltage for the microprocessor 31. The oscillator 33 provides a constant frequency to the microprocessor 31. The PNP transistor 34 has its base connected to the output end 0 of the microprocessor 31 through a current limit resistor R2, its emitter connected to the positive terminal of the battery 11 through the voltage control IC 32, and its collector connected to the negative terminal of the battery 11 through a resistor R1. The MOS field effect transistor 35 has its gate G connected to the emitter of the PNP transistor 34, its drain D connected to the positive terminal of the lamp bulb 21 and the positive terminal of the battery 11, and its source S connected to the negative terminal of the battery 11, forming a driving and amplifying circuit adapted to control the lightening of the lamp bulb 21. The selector switch 13 is connected to the input end I of the microprocessor 31. The trigger switch 14 is connected to the input end of the microprocessor 31. The touch control interface of the trigger switch 14 is mounted in the rear cover 15 of the barrel 1. Further, a charging jack 16 is installed in the rear cover 15 of the barrel 1 for receiving a charging cable (not shown) to charge the battery 11. By means of operating the selector switch 13 or the trigger switch 14, the microprocessor 31 is driven to control the bandwidth of the MOS field effect transistor 35, so as to regulate the intensity of light of the lamp bulb 21 steplessly, or to flash the lamp bulb 21.

Figure 5A:
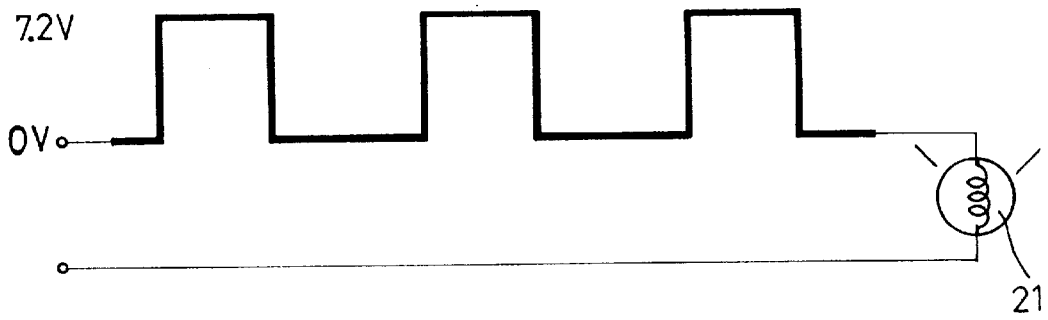
FIG. 5 (A)-(B)-(C) shows different waveforms adjusted through the controller according to the present invention.
Figure 5B:
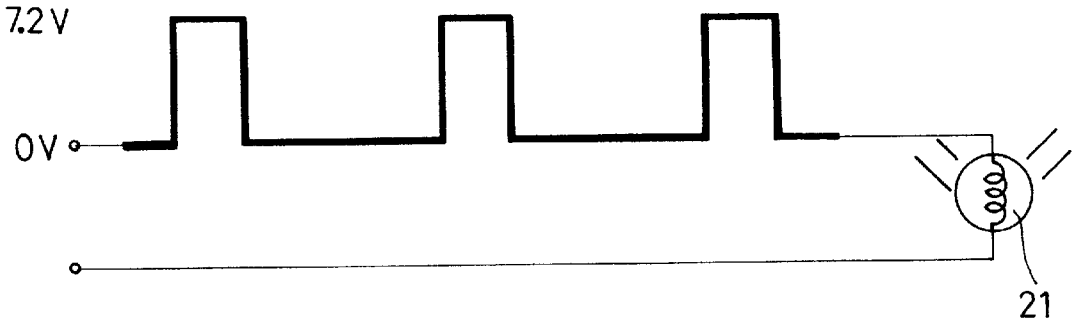
Figure 5C:
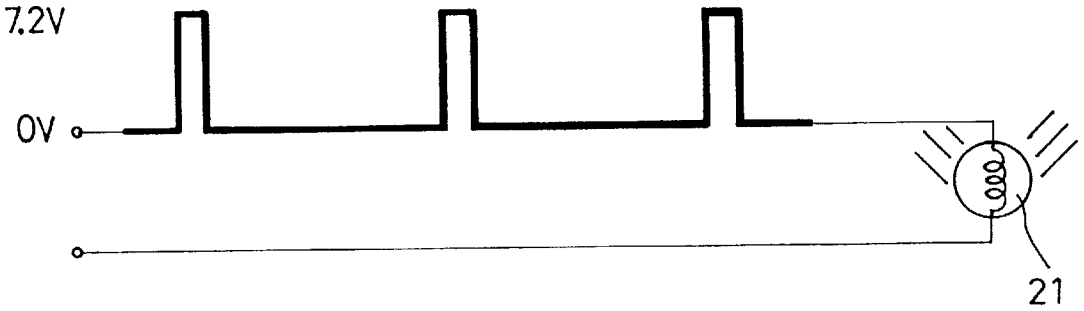

Further, the MOS field effect transistor 35 is of a single gate. Alternatively, the MOS field effect transistor 35 can be off dual gate to enhance the effect. Either single gate or dual gate, the MOS field effect transistor 35 matches the PNP transistor 34 to work with the microprocessor 31 in achieving stepless fine light intensity control or flashing control. The microprocessor 31 of the controller 3 has memory function. When operating the selector switch 13 to provide a control signal to the microprocessor 31, the PNP transistor 34 drives the MOS field effect transistor 35 to adjust its bandwidth, as shown in FIGS. 5(A)~5(C), so as to further regulate the intensity of light of the lamp bulb 21. The intensity of light of the lamp bulb 21 is directly proportional to the bandwidth of the MOS field effect transistor 35. In FIG. 5(A), the bandwidth of the MOS field effect transistor 35 is relatively narrower, and the intensity of light of the lamp bulb 21 is relatively weaker. In FIG. 5(C), the bandwidth of the MOS field effect transistor 35 is relatively wider, and the intensity of light of the lamp bulb 21 is relatively stronger. Therefore, the invention achieves regulating the intensity of light of the lamp bulb 21 without changing the voltage. Because changing the voltage may cause a power loss or overheat, it is not suitable for a flashlight that uses low voltage DC power supply. Because the controller 3 is formed of the microprocessor 31 and the driving and amplifying circuit of the PNP transistor 34 and the MOS field effect transistor 35, it is compact and, can be conveniently installed in the flashlight.

As indicated above, when operating the trigger switch 14 at the rear cover 15 of the barrel 1, a trigger signal is inputted to the microprocessor 31, causing its to flash the lamp bulb 21. Therefore, the flashlight can be used as a signal light on a finishing boat, or light means to aim at the object when shooting. Further, an external control interface or control switch 4 may be connected to the trigger switch 14.

While only one embodiment of the present invention has been shown and described, it will be understood that various modifications and changes could be made thereunto without departing from the spirit and scope of the invention disclosed.

What the invention claimed is:

1. A multipurpose flashlight comprising a barrel, said barrel comprising a front end, a rear end, and a rear cover covered on said rear end, a battery mounted inside said barrel, an ON/OFF switch and a selector switch mounted on said barrel for operation by hand, and a lamp head connected to the front end of said barrel and holding a lamp bulb, wherein the flashlight further comprises a controller installed in said barrel and adapted to regulate the intensity of light of said lamp bulb, said controller comprising a voltage control IC, a microprocessor, which obtains the necessary working voltage from said battery through said voltage control IC, an oscillator, which provides an oscillating frequency to said microprocessor, a PNP transistor, said PNP transistor having a base connected to an output end of said microprocessor through a current limit resistor, an emitter connected to the positive terminal of said battery through said voltage control IC, and a collector connected to the negative terminal of said battery through a resistor, a MOS field effect transistor, said MOS field effect transistor having a gate connected to the collector of said PNP transistor, a drain connected to the positive terminal of said lamp bulb and the positive terminal of said battery, and a source connected to the negative terminal of said battery to form a driving and amplifying circuit adapted to control the lightening of said lamp bulb, and a trigger switch connected to an input end of said microprocessor and adapted to drive said microprocessor to flash said lamp bulb, said trigger switch having a touch control interface disposed at the rear cover of said barrel; said selector switch is connected to an input end of said microprocessor and adapted to drive said microprocessor to regulate the intensity of light of said lamp bulb.

2. The flashlight of claim 1 further comprising a charging jack installed in the rear cover of said barrel and adapted to receive a charging cable for charging said battery.

* * * * *